US009182157B2

(12) United States Patent
Boarman et al.

(10) Patent No.: US 9,182,157 B2
(45) Date of Patent: Nov. 10, 2015

(54) ON-DOOR ICE MAKER COOLING

(71) Applicant: Whirlpool Corporation, Benton Harbor, MI (US)

(72) Inventors: Patrick J. Boarman, Evansville, IN (US); Gregory Gene Hortin, Henderson, KY (US); Mark E. Thomas, Corydon, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 108 days.

(21) Appl. No.: 13/691,878

(22) Filed: Dec. 3, 2012

(65) Prior Publication Data

US 2014/0150465 A1 Jun. 5, 2014

(51) Int. Cl.

| | |
|---|---|
| ***F25B 21/02*** | (2006.01) |
| ***F25C 1/04*** | (2006.01) |
| ***F25C 5/18*** | (2006.01) |
| ***F25D 17/02*** | (2006.01) |
| *F25D 23/04* | (2006.01) |

(52) U.S. Cl.

CPC . *F25B 21/02* (2013.01); *F25C 1/04* (2013.01); *F25C 5/182* (2013.01); *F25D 17/02* (2013.01); *F25C 2400/10* (2013.01); *F25D 23/04* (2013.01)

(58) Field of Classification Search

CPC ..... F25B 21/02; F25C 1/04; F25C 5/182; F25C 2400/10; F25D 17/02; F25D 23/04

USPC ..... 62/3.63, 449, 344, 420, 135

See application file for complete search history.

(56) References Cited

U.S. PATENT DOCUMENTS

| | | | | |
|---|---|---|---|---|
| 3,075,360 | A | 1/1963 | Elfving | |
| 3,100,970 | A | 8/1963 | Elfving | |
| 3,146,601 | A | 9/1964 | Gould | |
| 3,200,600 | A | 8/1965 | Elfving | |
| 4,257,237 | A * | 3/1981 | Hoenisch | 62/157 |
| 4,487,024 | A * | 12/1984 | Fletcher et al. | 62/3.63 |
| 6,003,319 | A | 12/1999 | Gilley | |
| 6,293,107 | B1 * | 9/2001 | Kitagawa et al. | 62/3.6 |
| 6,401,461 | B1 | 6/2002 | Harrison | |
| 6,735,959 | B1 | 5/2004 | Najewicz | |
| 7,188,479 | B2 * | 3/2007 | Anselmino et al. | 62/66 |
| 7,228,703 | B2 * | 6/2007 | Kim et al. | 62/353 |

(Continued)

FOREIGN PATENT DOCUMENTS

| | | | |
|---|---|---|---|
| DE | 102010001465 | A1 | 8/2011 |
| DE | 102010042080 | A1 | 4/2012 |

(Continued)

OTHER PUBLICATIONS

EP Search Opinion, EP2738483, Dated Feb. 2, 2015.

(Continued)

*Primary Examiner* — Mohammad M Ali

(57) ABSTRACT

A refrigerator includes a refrigerator cabinet, a refrigerator compartment disposed within the refrigerator cabinet, a refrigerator compartment door for providing access to the refrigerator compartment, an ice maker on the refrigerator compartment door, a thermoelectric cooler associated with the ice maker and operatively connected to the refrigerator compartment door, the thermoelectric cooler having a first side and an opposite second side, and a cooling loop operatively connected to the refrigerator compartment door and configured for cooling the thermoelectric cooler.

20 Claims, 8 Drawing Sheets

(56) References Cited

U.S. PATENT DOCUMENTS

| | | | | |
|---|---|---|---|---|
| 7,278,269 | B2 | 10/2007 | Pham | |
| 7,278,569 | B2 | 10/2007 | Cohen | |
| 7,284,379 | B2 | 10/2007 | Pham | |
| 7,310,953 | B2 | 12/2007 | Pham | |
| 7,591,141 | B2 | 9/2009 | Wetekamp | |
| 7,752,852 | B2 | 7/2010 | Akei et al. | |
| 7,841,192 | B2 * | 11/2010 | Rafalovich et al. | 62/135 |
| 7,870,745 | B2 | 1/2011 | Goenka | |
| 8,099,975 | B2 | 1/2012 | Rafalovich | |
| 8,505,325 | B2 * | 8/2013 | Kang et al. | 62/340 |
| 8,572,999 | B2 * | 11/2013 | Kim et al. | 62/344 |
| 8,794,014 | B2 * | 8/2014 | Kulkarni et al. | 62/66 |
| 2003/0029174 | A1 | 2/2003 | Lee | |
| 2006/0086130 | A1 * | 4/2006 | Anselmino et al. | 62/344 |
| 2006/0168983 | A1 | 8/2006 | Tatsui | |
| 2006/0260325 | A1 | 11/2006 | Lin | |
| 2006/0260333 | A1 | 11/2006 | Wetekamp | |
| 2006/0260350 | A1 | 11/2006 | Van Meter | |
| 2007/0251261 | A1 * | 11/2007 | Son et al. | 62/390 |
| 2008/0041066 | A1 | 2/2008 | Luo | |
| 2009/0049858 | A1 | 2/2009 | Lee | |
| 2009/0158768 | A1 | 6/2009 | Rafalovich | |
| 2009/0158928 | A1 | 6/2009 | Wu | |
| 2009/0260374 | A1 | 10/2009 | Wang | |
| 2009/0293501 | A1 * | 12/2009 | Kulkarni et al. | 62/3.63 |
| 2010/0126185 | A1 * | 5/2010 | Cho et al. | 62/3.63 |
| 2011/0000238 | A1 * | 1/2011 | Wetekamp et al. | 62/151 |
| 2011/0113810 | A1 | 5/2011 | Mitchell | |
| 2012/0042681 | A1 * | 2/2012 | McDaniel | 62/353 |
| 2012/0085120 | A1 * | 4/2012 | Davis et al. | 62/340 |
| 2012/0167596 | A1 | 7/2012 | Krause | |

FOREIGN PATENT DOCUMENTS

| | | | |
|---|---|---|---|
| EP | 1253387 | A1 | 10/2002 |
| EP | 1684036 | A2 | 7/2006 |
| EP | 1821051 | A1 | 8/2007 |
| EP | 2444761 | A2 | 4/2012 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.

* cited by examiner

ON-DOOR ICE MAKER COOLING

FIELD OF THE INVENTION

The present invention relates to ice makers. More particularly, but not exclusively, the present invention relates to cooling an ice maker on a door of a refrigerator.

BACKGROUND OF THE INVENTION

Refrigerators have long provided for making ice. Some refrigerators include ice makers on a door of the fresh food compartment. Yet, problems remain with cooling the ice makers and or ice storage bins. What is needed is a refrigerator which provides for on the door ice maker cooling.

SUMMARY

Therefore, it is a primary object, feature, or advantage of the present invention to improve over the state of the art.

It is a further object, feature, or advantage of the present invention to provide a refrigerator which provides for on the door cooling.

Yet another object, feature, or advantage of the present invention is to provide a refrigerator which may make clear ice.

One or more of these and/or other objects, features, or advantages of the present invention will become apparent from the specification and claims that follow. No single embodiment need meet or provide each and every object, feature, or advantage. Different embodiments may have different objects, features, or advantages. The present invention is not to be limited by or to these objects, features, or advantages.

According to one aspect, a refrigerator is provided. The refrigerator includes a refrigerator cabinet, a refrigerator compartment disposed within the refrigerator cabinet, a refrigerator compartment door for providing access to the refrigerator compartment, an ice maker on the refrigerator compartment door, a thermoelectric cooler associated with the ice maker and operatively connected to the refrigerator compartment door, the thermoelectric cooler having a first side and an opposite second side, and a cooling loop operatively connected to the refrigerator compartment door and configured for cooling the thermoelectric cooler. The refrigerator may further include a heat sink thermally coupled with one of the first side and the opposite second side. There may be cooling media within the cooling loop such as glycol and/or water. The cooling loop may further provide for heating water to provide heated water. The refrigerator may further include a dispenser on the refrigerator compartment door and adapted to dispense the heated water.

According to another aspect, a method of making ice on a door of a refrigerator is provided. The method includes providing a refrigerator, the refrigerator having a refrigerator cabinet, a refrigerator compartment disposed within the refrigerator cabinet, a refrigerator compartment door for providing access to the refrigerator compartment, an ice maker on the refrigerator compartment door, a thermoelectric cooler associated with the ice maker and operatively connected to the refrigerator compartment door, the thermoelectric cooler having a first side and an opposite second side, and a cooling loop operatively connected to the refrigerator compartment door. The method further provides for cooling a surface associated with the ice maker using the first side of the thermoelectric cooler. The method further provides for circulating cooling media through the cooling loop to cool the second side of the thermoelectric cooler. The method may further include cooling water by circulating the cooling media through the cooling loop. The method may further include heating water or ice by circulating the cooling media through the cooling loop. The refrigerator may further include a fan associated with the refrigerator compartment door and further comprising altering temperature in the refrigerator compartment door using the fan.

According to another aspect, a refrigerator is provided. The refrigerator may include a refrigerator cabinet, a refrigerator compartment disposed within the refrigerator cabinet, a refrigerator compartment door for providing access to the refrigerator compartment, an ice maker on the refrigerator compartment door, and a fluid cooled thermoelectric cooler associated with the ice maker and operatively connected to the refrigerator compartment door.

DETAILED DESCRIPTION OF THE PREFERRED EMBODIMENT

Figure 1:
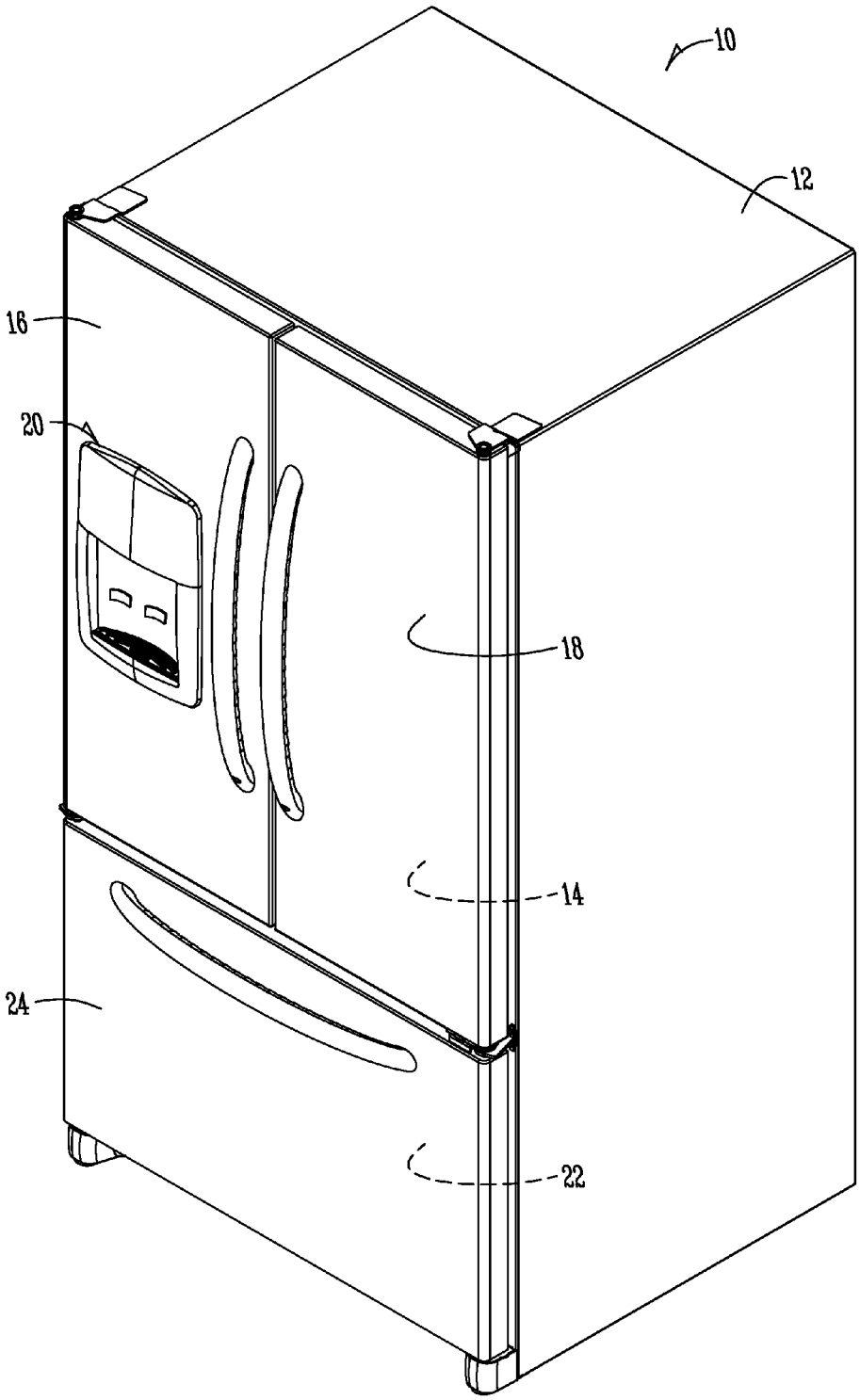
FIG. 1 is a perspective view of one example of a refrigerator of the present invention.

FIG. 1 illustrates one embodiment of a refrigerator of the present invention. In FIG. 1 a refrigerator 10 has a bottom mount freezer with French doors. It is should be understood that the present invention may be used in other configurations including side-by-side refrigerator configurations and other types of configurations, especially where an ice maker and/or ice storage is on a door providing access to a fresh food compartment. The refrigerator 10 has a refrigerator cabinet 12. One or more compartments are disposed within the refrigerator cabinet 12. As shown in FIG. 1, a fresh food compartment 14 is shown with French doors 16, 18 providing access to the fresh food compartment 14. Mounted on the door 16 is a water and ice dispenser 20. Below the fresh food compartment 14 is a freezer compartment 22 which may be accessed by pulling drawer 24 outwardly.

Figure 2:
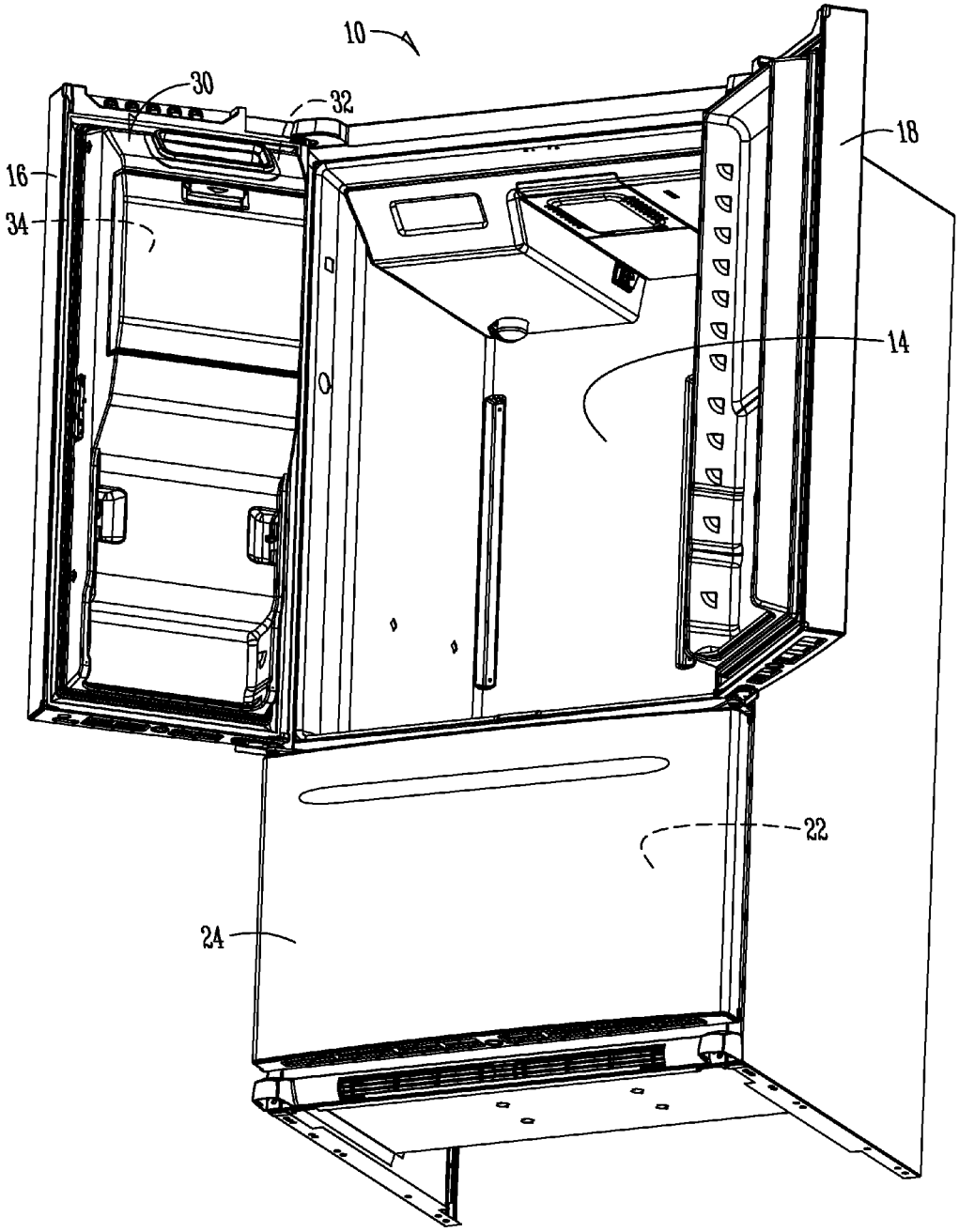
FIG. 2 is a perspective view of the refrigerator of FIG. 1 with the French doors in an open position.

FIG. 2 illustrates the refrigerator 10 of FIG. 1 with French doors 16, 18 in an open position. Mounted on the French door 16 is an ice making compartment 30 in which an ice maker 32 and an ice storage bucket 34 may be disposed. Note the ice making compartment as shown in FIG. 2 is within the refrigeration or fresh food compartment 14.

Figure 3:
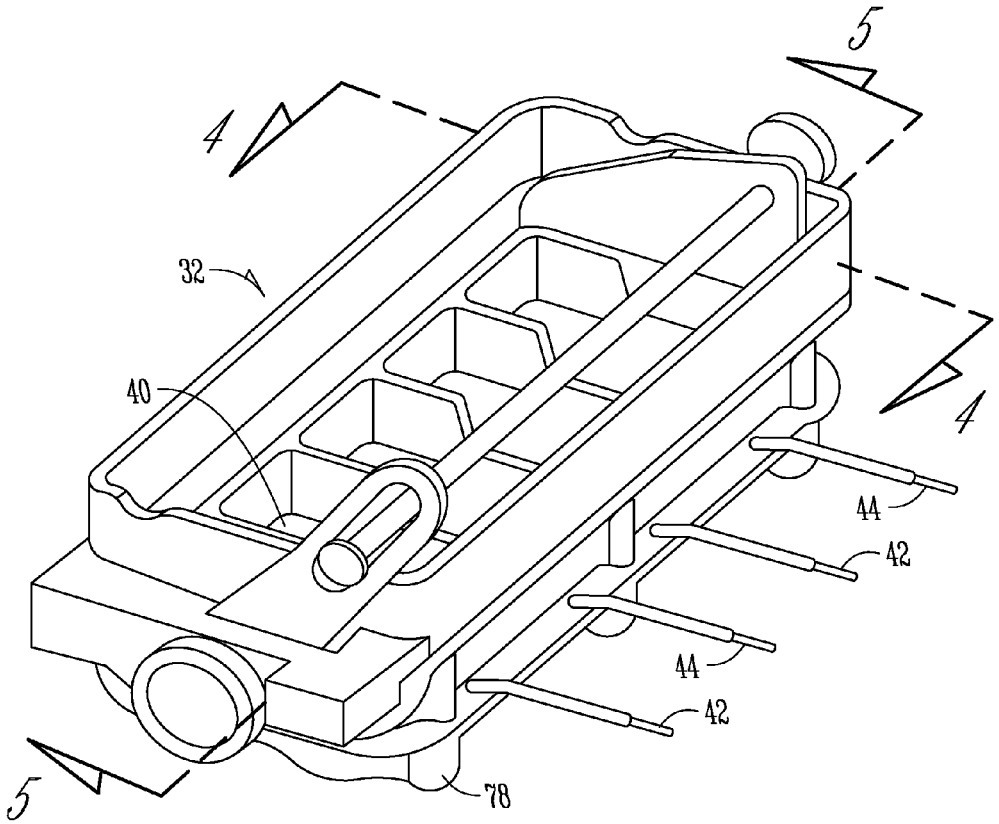
FIG. 3 is a perspective view of one example of an ice maker of the present invention.
Figure 4:
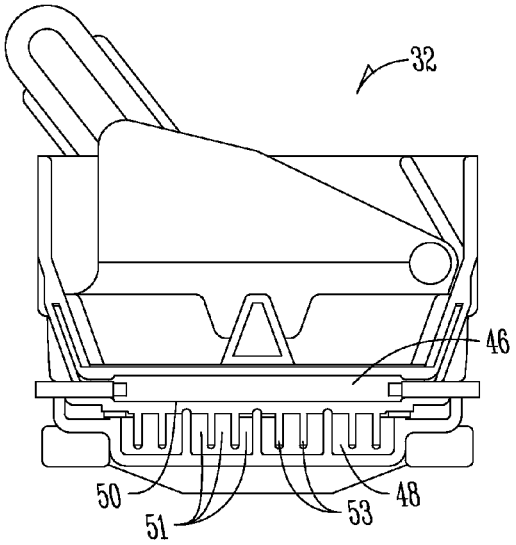
FIG. 4 is a cross-sectional view of the ice maker of FIG. 3 taken along section line 4-4.
Figure 5:
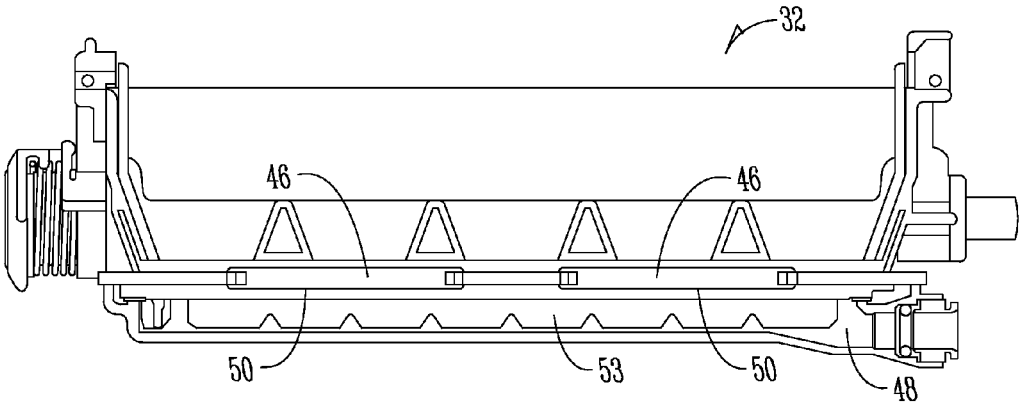
FIG. 5 is a cross-sectional view of the ice maker of FIG. 3 taken along section line 5-5.

FIG. 3 illustrates one example of an ice maker 32 where a liquid cooled system is used for freezing water into ice. An ice mold 40 is positioned above a thermoelectric cooler (TEC). The ice mold 40 is preferably fixed in place during harvesting of the ice. FIG. 4 illustrates an end view of the ice maker showing the thermoelectric cooler 46 with electrical inputs 42, 44 shown. Fluid is shown in fluid line 48 which is in contact with a bottom side 50 of the thermoelectric cooler 46. The fluid line 48 comprises a plurality of channels 51 at least partially separated by a plurality of fins 53. Thus, in operation fluid within the fluid line 48 can remove heat from the thermoelectric cooler 46. FIG. 5 provides another illustration where one or more thermoelectric coolers 46 are used to remove heat from an ice maker using liquid cooling. During harvest, heat may be provided to the ice mold. The heat may be provided through the thermoelectric cooler or through warm fluid through the fluid line 48.

Figure 6:
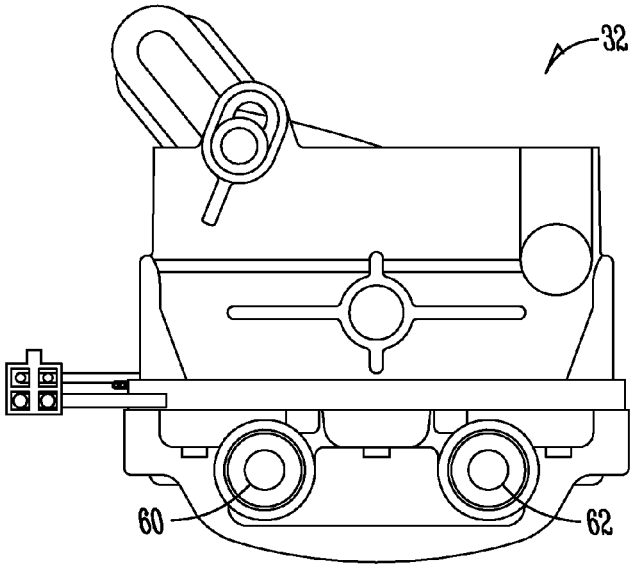
FIG. 6 is an end view of the ice maker showing an inlet and outlet for the fluid loop.

FIG. 6 is an end view of the ice maker 32. The ice maker 32 has a fluid inlet 60 and a fluid outlet 62 for the fluid loop.

Figure 7:
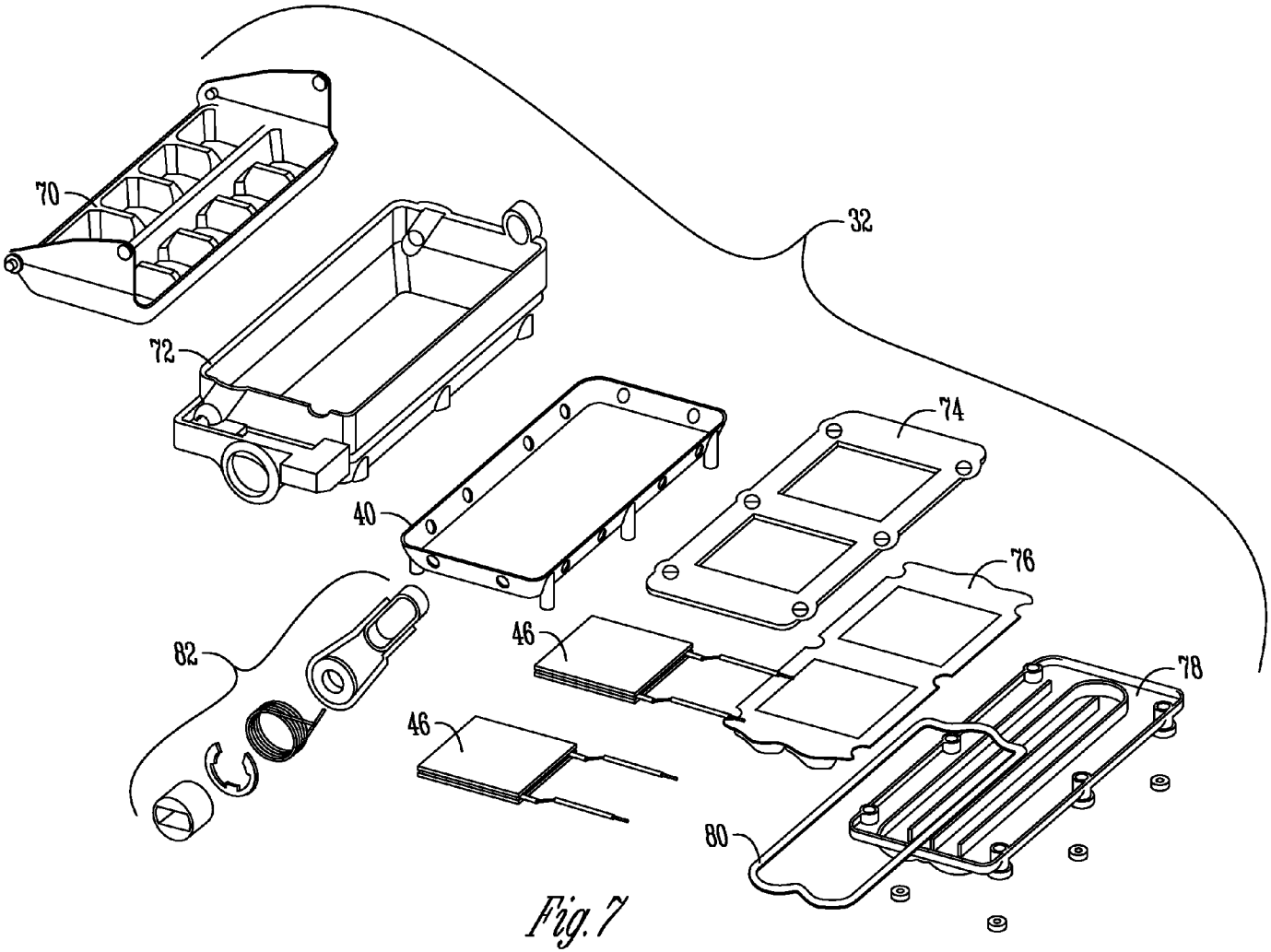
FIG. 7 is an exploded view of the ice maker.

FIG. 7 is an exploded view of the ice maker 32. The ice maker 32 has a flex grid 70 which sits inside a molded tray wall 72. A tray cold plate 40 is also shown along with a gasket 74 with openings for thermoelectric devices 46. A transfer plate 76 is also provided as is a transfer cover 78 and a seal 80 for sealing the transfer cover 78 to the transfer plate 76. A harvest assembly 82 is shown which may be used for harvesting ice from the ice maker 32.

Figure 8:
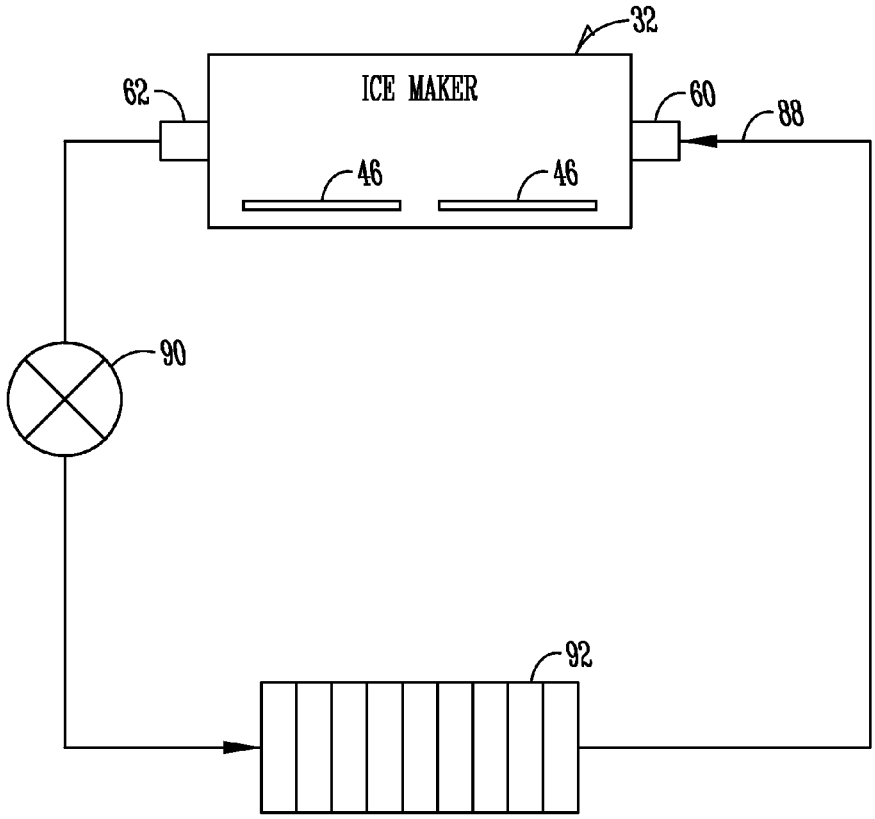
FIG. 8 is a diagram illustrating one example of a fluid loop.

FIG. 8 is a diagram illustrating one example of a fluid loop 88 through the ice maker 32 with thermo electric coolers 46. Fluid is received through the fluid inlet 60 for cooling the thermo electric coolers 46. As a result of the cooling process the temperature of the fluid increases so that fluid leaving the ice maker 32 at the fluid outlet 62 may be warm. A pump 90 may be placed within the fluid loop 88 to pump the fluid through the fluid loop 88. A heat exchanger 92 is provided which provides for removing heat from the fluid in the fluid loop 88. Heat may be removed in any number of ways. For example, a fan may be used to drive cooling air from any number of sources to cool fluid within the fluid loop 88, although any number of types and configurations of heat exchangers may be used.

Figure 9:
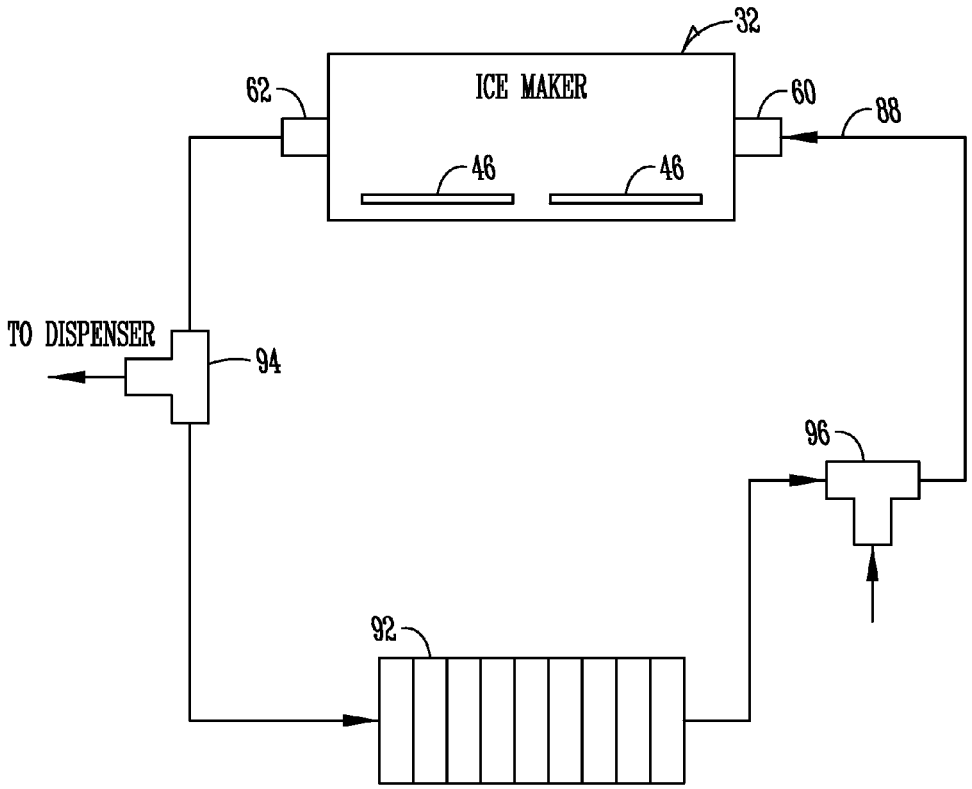
FIG. 9 is a diagram illustrating another example of a fluid loop.

FIG. 9 is a diagram illustrating another example of a fluid loop 88 through the ice maker 32 with thermo electric coolers 46. Fluid such as water is received through the fluid inlet 60 for cooling the thermo electric coolers 46. As a result of the cooling process the temperature of the fluid increases so that fluid leaving the ice maker 32 at the fluid outlet 62 may be warm. A valve 94 is shown which allows for the warm fluid to be released to a water dispenser or otherwise. It is to be understood that the warm fluid is not necessarily hot but may be, for example, room temperature. Thus, room temperature water may be dispensed for drinking or other purposes without needing to provide additional heating or else the warm water may be further heated using only a limited amount of additional energy to provide an even higher temperature. Thus, energy savings can be achieved in this way as well. The valve 94 which may be electronically controlled allows a portion of the warm water to be directed to the water dispenser or otherwise and a remaining portion of the water to be circulated to the heat exchanger 92. Because water may be removed from the fluid loop 88 at the valve 94, another valve 96 is provided which allows for additional fluid to be added to the system. The valve 96 as shown is positioned after the heat exchanger 92, although depending upon temperature of fluid being added, fluid could be added elsewhere in the loop 88.

Thus, the present invention provides for using a thermoelectric cooler to be used in making ice. The ice maker may reside in the refrigerator compartment at above freezing temperature, particularly where clear ice is desired. Alternatively, the ice maker may reside in the freezer compartment.

Therefore, a refrigerator which provides for on the door cooling has been provided. The present invention contemplates numerous variations including the number and placement of thermoelectric coolers where used, the manner in which fluid cooling is used, the type of cooling fluid, the placement of the ice maker, and other options, variations, and alternatives. In general, the present invention is only intended to be limited by the scope of the following claims.

What is claimed is:

1. A refrigerator comprising:

a refrigerator cabinet;

a refrigerator compartment disposed within the refrigerator cabinet;

a refrigerator compartment door for providing access to the refrigerator compartment;

an ice maker on the refrigerator compartment door;

a thermoelectric cooler associated with the ice maker and operatively connected to the refrigerator compartment door, the thermoelectric cooler having a first side and an opposite second side;

a liquid cooling loop comprising a plurality of channels, the liquid cooling loop being operatively connected to the refrigerator compartment door and configured to cool one of the first side and the opposite second side of the thermoelectric cooler.

2. The refrigerator of claim 1 wherein the plurality of channels is substantially parallel.

3. The refrigerator of claim 1 further comprising liquid cooling media within the cooling loop.

4. The refrigerator of claim 3 wherein the liquid cooling media comprises at least one of glycol or water.

5. The refrigerator of claim 1 wherein the liquid cooling loop further provides for heating water to provide heated water.

6. The refrigerator of claim 5 further comprising a dispenser on the refrigerator compartment door adapted to dispense the heated water.

7. The refrigerator of claim 1 further comprising an ice storage bucket operatively connected to the refrigerator compartment door and a pathway conveying ice from the ice maker to the ice storage bucket.

8. The refrigerator of claim 1 further comprising a fluid pump operatively connected to the cooling loop for circulating cooling media through the fluid loop.

9. The refrigerator of claim 1 further comprising a fan at the refrigerator compartment door for circulating air to and from the refrigerator compartment in manner that alters temperature of the air.

10. The refrigerator of claim 9 wherein the temperature is reduced.

11. The refrigerator of claim 9 wherein the temperature is increased.

12. The refrigerator of claim 11 further comprising a heat sink and wherein the fan circulates the air by the heat sink to increase the temperature of the air.

13. The refrigerator of claim 1 further comprising a second refrigerator compartment door and wherein the refrigerator compartment door and the second refrigerator compartment door are French doors.

14. The refrigerator of claim 13 further comprising a freezer compartment disposed below the refrigerator compartment.

15. The refrigerator of claim 1 further comprising a hinge operatively connected between the refrigerator compartment door and the refrigerator cabinet and wherein the cooling loop contains cooling media, with no cooling media crossing the hinge.

16. A method of making ice on a door of a refrigerator, the method comprising;

providing a refrigerator comprising (a) a refrigerator cabinet, (b) a refrigerator compartment disposed within the refrigerator cabinet, (c) a refrigerator compartment door for providing access to the refrigerator compartment, (d) an ice maker on the refrigerator compartment door, (e) a thermoelectric cooler associated with the ice maker and operatively connected to the refrigerator compartment door, the thermoelectric cooler having a first side and an opposite second side, and (f) a plurality of channels associated with a liquid cooling loop operatively connected to the refrigerator compartment door;

cooling a surface associated with the ice maker using the first side of the thermoelectric cooler;

circulating liquid cooling media through the plurality of channels to cool the second side of the thermoelectric cooler.

17. The method of claim 16 further comprising cooling water by circulating the liquid cooling media through the cooling loop.

18. The method of claim 16 further comprising heating water or ice by circulating the liquid cooling media through the liquid cooling loop.

19. The method of claim 16 wherein the refrigerator further comprises a fan associated with the refrigerator compartment door and further comprising altering temperature in the refrigerator compartment door using the fan.

20. A refrigerator comprising:

a refrigerator cabinet;

a refrigerator compartment disposed within the refrigerator cabinet;

a refrigerator compartment door for providing access to the refrigerator compartment;

an ice maker on the refrigerator compartment door;

a liquid cooled thermoelectric cooler associated with the ice maker and operatively connected to the refrigerator compartment door; and a transfer plate having a plurality of fins configured to transfer heat from the liquid cool thermoelectric cooler to liquid passing between the plurality of fins.

* * * * *